US005413027A

United States Patent [19]

Mixon

[11] Patent Number: 5,413,027

[45] Date of Patent: May 9, 1995

[54] REACTIVE ARMOR WITH RADAR ABSORBING STRUCTURE

[75] Inventor: Larry C. Mixon, Huntsville, Ala.

[73] Assignee: The United States of America as represented by the Secretary of the Army, Washington, D.C.

[21] Appl. No.: 55,954

[22] Filed: Mar. 19, 1993

[51] Int. Cl.[6] ..... F41H 5/007

[52] U.S. Cl. ..... 89/36.17; 89/36.08; 342/3

[58] Field of Search ..... 89/36.08, 36.17; 342/1, 342/2, 3, 4

[56] References Cited

U.S. PATENT DOCUMENTS

| | | | |
|---|---|---|---|
| 4,368,660 | 1/1983 | Manfred | 89/36.17 |
| 4,606,848 | 8/1986 | Bond | 342/3 |
| 4,741,244 | 5/1988 | Ratner et al. | 89/36.17 |
| 4,928,575 | 5/1990 | Smirlock et al. | 89/36.08 |
| 5,070,764 | 12/1991 | Sherach et al. | 89/36.17 |

*Primary Examiner*—Stephen C. Bentley

*Attorney, Agent, or Firm*—Freddie M. Bush; Howard G. Garner

[57] ABSTRACT

A reactive armor box for protecting armor surfaces comprising a base for attachment to the armor surfaces, a plurality of walls extending from the base at an angle to provide an enclosed space, a plurality of explosive cassettes disposed within the enclosed space and supported and contained within the walls, and a top, attached to the walls to contain the cassettes in the enclosed space, which has radar absorbing characteristics for absorbing radio waves of the radar to avoid detection of the protected armor surface and to protect the armor surface from projectiles utilizing radio frequency guidance seekers. The top and the entire structure of the box on the invention may be formed of a light weight composite material which has the radar absorbing characteristics or the box may be formed of conventional metals with only the top surface of the box being formed of the radar absorbing materials.

20 Claims, 6 Drawing Sheets

REACTIVE ARMOR WITH RADAR ABSORBING STRUCTURE

DEDICATORY CLAUSE

The invention described herein may be manufactured, used, and licensed by or for the Government for governmental purposes without the payment to me of any royalties thereon.

BACKGROUND OF THE INVENTION

This invention is directed to a reactive armor box for protecting armor surfaces on vehicles and stationary installations from projectiles, particularly so-called hollow explosive charged projectiles. More particularly, this invention is directed to a reactive armor box for protecting armor surfaces of vehicles or stationary installations wherein at least one outer surface of the box has radar absorbing characteristics for absorbing radio waves of the radar to avoid detection of the protected armor surface and to protect said armor surface from projectiles utilizing radio frequency guidance seekers, and semiactive R.F. guidance systems.

A reactive armor box for protecting armor utilizing two or more explosive cassettes against the destructive force of projectiles including hollow explosive charge projectiles is well known. One such system or arrangement is disclosed in U.S. Pat. No. 4,368,660, issued Jan. 18, 1983, for "Protective Arrangement Against Projectiles, Particularly Hollow Explosive Charge Projectiles" to Manfred Held. The patentee states that his invention relates to a protective arrangement against projectiles where a wall structure is formed from a wall layer of explosive material, and at least one additional wall layer covering at least one face of the wall layer of explosive material. The additional wall layer is said to be a non-explosive, inert high-density material such as metal. The patentee states that in one embodiment both faces of the explosive wall layer are covered with a layer of inert, non-explosive high-density material such as metal. The protective arrangement is said to be particularly suitable for protection against the destructive force of hollow explosive charge projectiles.

Such protective arrangements are well known in the above identified art but have significant drawbacks. One significant drawback for such boxes or protective devices is that such armor boxes are generally very heavy and are constructed of dense metal material such as steel, and are consequently very heavy and difficult to handle. At times, such armor boxes must be removed from the surfaces which they protect and this heavy weight makes this difficult.

The reactive armor box is generally mounted on an armored surface at an angle to the attack of any jet shot line. When the jet shot line intercepts the first cassette, the explosive is ignited due to the impact forces of the jet shot line. This explosion detonates the metal plates which intercept the jet shot line at an angle, thereby further disrupting the jet shot line. The second cassette acts in the same manner to further weaken or deflect the jet shot line. The lateral strength of shaped charge jets is weak and even with the tip of the jet travelling at velocities up to 10,000 mps and the aft or rear portion of the jet travelling at 3,000 mps, such plates have proven to disrupt the jet shot line. Such boxes are typically mounted over thick armor such as Rolled Homogeneous Armor, ceramics, spaced angled steels, or other passive armor. Once the jet has been disrupted by the flying plates and the explosive charge, the passive armor will stop the remaining penetrator.

On the other hand, kinetic energy penetrators (typically long metal rods) are stronger in the lateral direction. Long rod kinetic energy penetrators are usually on the order of 1000 mm long with a diameter of 12 to 20 mm. The cassettes are not as effective against this type of penetrator, or, at least, the cassettes designed to interrupt shaped charge jets are not found to be as effective. The kinetic energy rod travels at a much lower velocity of 1,525 to 2,067 mps; consequently, by adjusting the size of the cassettes and the amount of explosive force contained therein to control its velocity, it is possible to optimize the reactive armor against this more formidable threat.

Armor effectiveness is measured by its ability to defeat the threat as a function of areal density or $Kg/m^2$. The steel design prior art box typically weighs 5.75 Kg and has an areal density of 146 $Kg/m^2$. This excessive weight makes the prior art armor boxes difficult to handle and adds to the weight of the vehicle to which they are added.

The steel design used in the prior art devices have the further drawback of readily reflecting radar or radio waves permitting the ready detection of the protective surface by radar and the use of terminal guided weapons or projectiles that use radio frequency guidances, such as 35 GHz and 94 GHz seekers, thereby making the protected armor surface susceptible to such homing missiles or projectiles.

SUMMARY OF THE INVENTION

It is an object of the invention to produce a reactive armor box for protecting armor surfaces of vehicles such as tanks, ships, and aircraft or stationary installations and the like from projectiles, utilizing composite light weight materials for reducing the weight of the effective armor box without reducing its effectiveness against such projectiles.

It is another object of the invention to provide a reactive armor box for protecting armor surfaces of vehicles such as tanks, ships, and aircraft or stationary installations from projectiles which are guided to the surfaces by radio frequency guidance seekers.

It is still another object of the invention to provide a reactive armor box for protecting armor surfaces of vehicles such as tanks, ships or aircraft and stationary installations and the like from projectiles, which permit the easy removal or relocation of such armor boxes without impairing the effectiveness of its attachment to the armor surfaces it is designed to protect.

These objects and others which will become apparent are realized by the provision of a reactive armor box for protecting armor surfaces of vehicles such as tanks, ships, or aircraft and stationary installations and the like from incoming projectiles. The armor box comprises a base for attachment to the armor surface to be protected and a plurality of upwardly extending walls from the base to provide an enclosed spaced. A plurality of explosive cassettes are disposed within the enclosed space and supported and contained within the walls. A top is attached to the walls or is an integral part of the walls to contain the cassettes in the enclosed space. The top surface of the top has radar absorbing characteristics for absorbing the radio waves of the radar to avoid detection of the protected armor surface and to protect the armor surface from projectiles utilizing radio frequency guided seekers.

BRIEF DESCRIPTION OF THE DRAWINGS

The invention will now be described in connection with the appended drawings, in which.

DETAILED DESCRIPTION OF THE INVENTION

Figure 1:
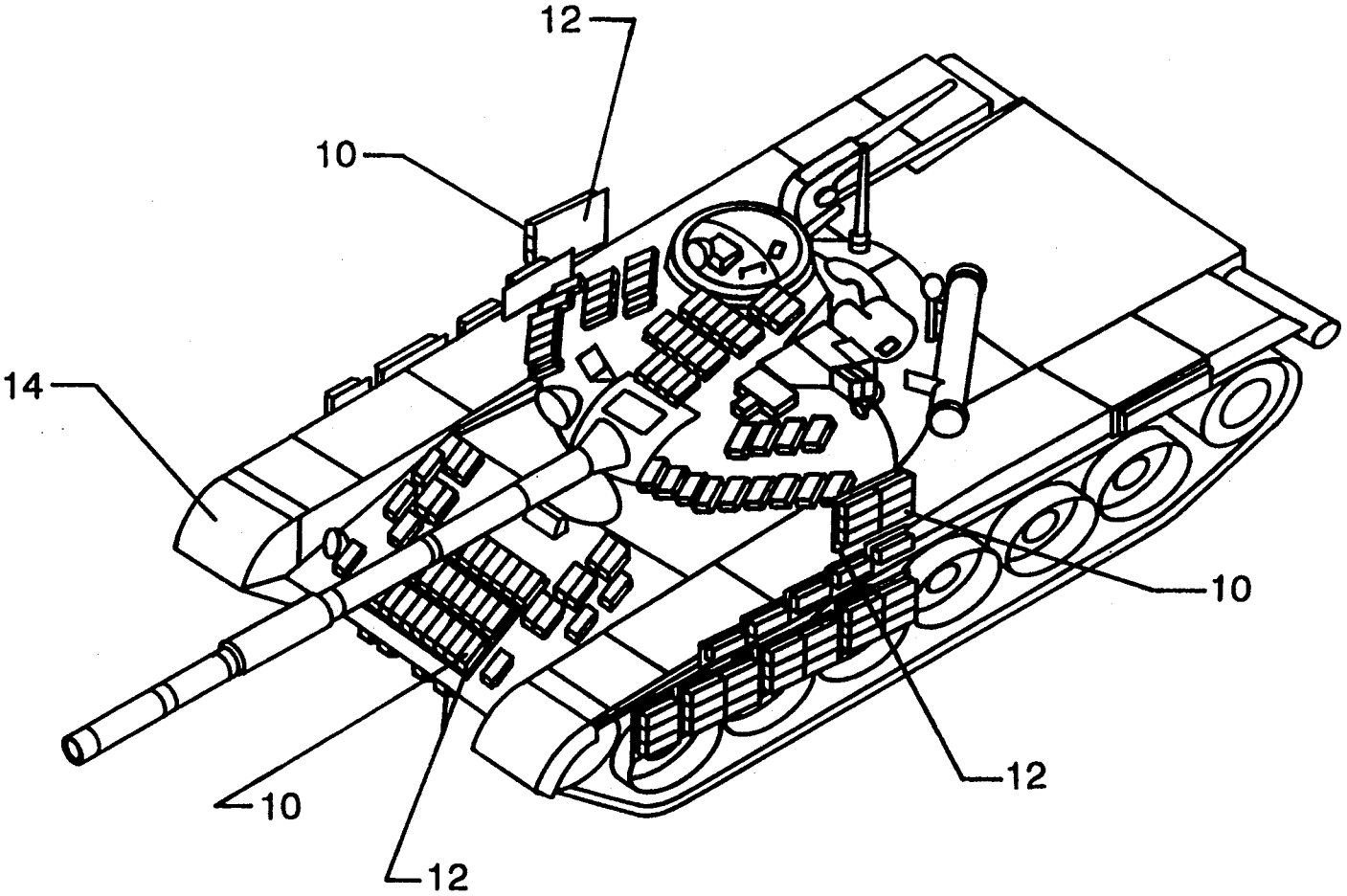
FIG. 1 is a perspective view of a tank showing how the armor box of the invention is applied to its armored surfaces.

FIG. 1 of the drawings illustrates an armored vehicle such as a tank 14 with a plurality of reactive armor boxes 10 attached to the armor surface 12 of tank 14. Such reactive armor boxes are disposed on various surfaces of armored vehicles to provide protection from projectiles.

Figure 2:
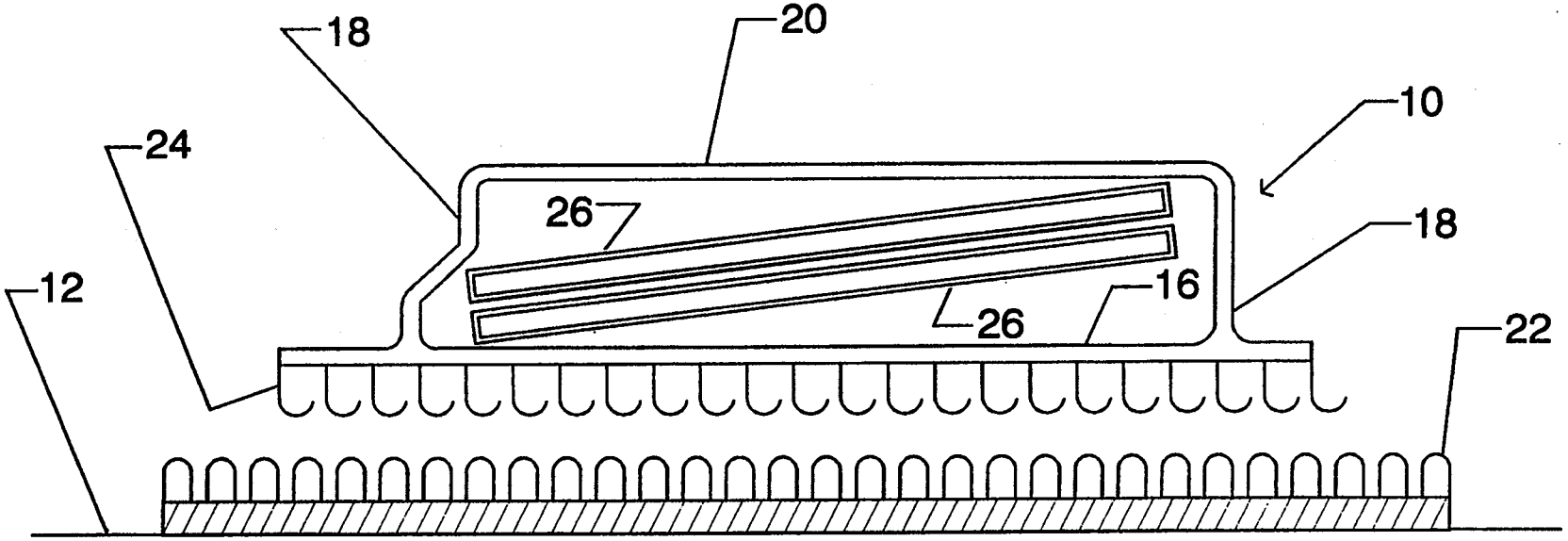
FIG. 2 is a side cross-sectional view of one embodiment of the reactive armor box of the invention.

Referring now to FIG. 2 of the drawings wherein the reactive armor box 10 is illustrated in cross-section. As seen in FIG. 2, box 10 comprises a base portion 16 with a plurality of upwardly extending walls 18 from one surface of base 16 and a top 20 attached to walls 18, and enclosing an open space between the walls and the base and the top. A plurality of explosive cassettes 26 similar to those illustrated and disclosed in U.S. Pat. No. 4,368,660, as identified hereinabove, are disposed for defeating projectiles which impinge upon and penetrate reactive armor box 10. The explosive cassettes 26 deflect the incoming projectile or its jet shot line as described in the above-identified Held patent. At least top 20 of reactive armor box 10 comprises a material which has proven to be effective for absorbing radar radio waves. This surface may include circuit analog sheets in conjunction with a thin magnetic absorber and be part of a composite which is optimized for stiffness and durability and light weight.

Such composites permit refinements such as rounded corners with small weight penalty and simplifies fabrication techniques. For example, the box could be injection or compression molded utilizing chopped fiber glass for reinforcement. Other techniques would be to form such top by resin transfer molding or pultrusion.

The pultrusion system permits continuous mass production and can provide long lengths of boxes which are easily cut to the desire length or width with the ends of the boxes enclosed by flat composite sheets which are connected to the top and base and the connecting walls by means of an adhesive, all of which are well known in the art.

Another advantage of the use of such composites is the ability to contour the reactive armor box to match the contour of the basic platform so as to minimize the radar cross-section return.

As also seen in FIG. 2, the bottom surface of base 16 is provided with a attachment means such as hooks 24 which penetrate a pile fabric 22 supported on armor surface 12 for easy attachment and disassembly from the protective surface. The fastener illustrated in FIG. 2 is a heavy duty, industrial type which could be formed of metal or heavy duty nylon hooks for pile fabric to permit the secure attachment of the reactive armor box to the surface to be protected by it.

Figure 3:
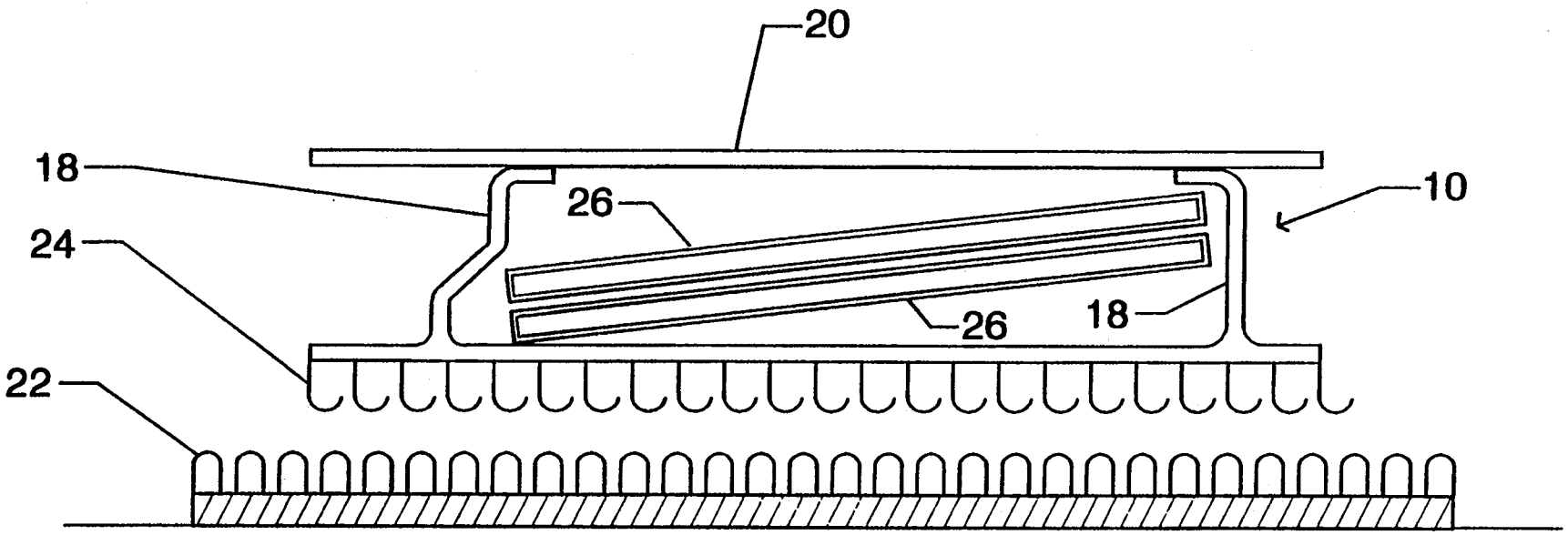
FIG. 3 is a side cross-sectional view of another embodiment of the reactive armor box of the invention.

FIG. 3 illustrates an alternative embodiment of the invention wherein top 20' is formed of the radar absorbent material or composite while the remaining portion of box 10 may be formed of steel or the like. In this case, top 20' is attached to walls 18 by means an adhesive or mechanical fastener means such as screws or the like, making it readily simple to relocate cassettes 26 within the box or to add additional cassettes where such additional protection is deemed to be necessary. Other fasteners which can be used are quick release fasteners normally used in the aircraft industry.

Figure 4:
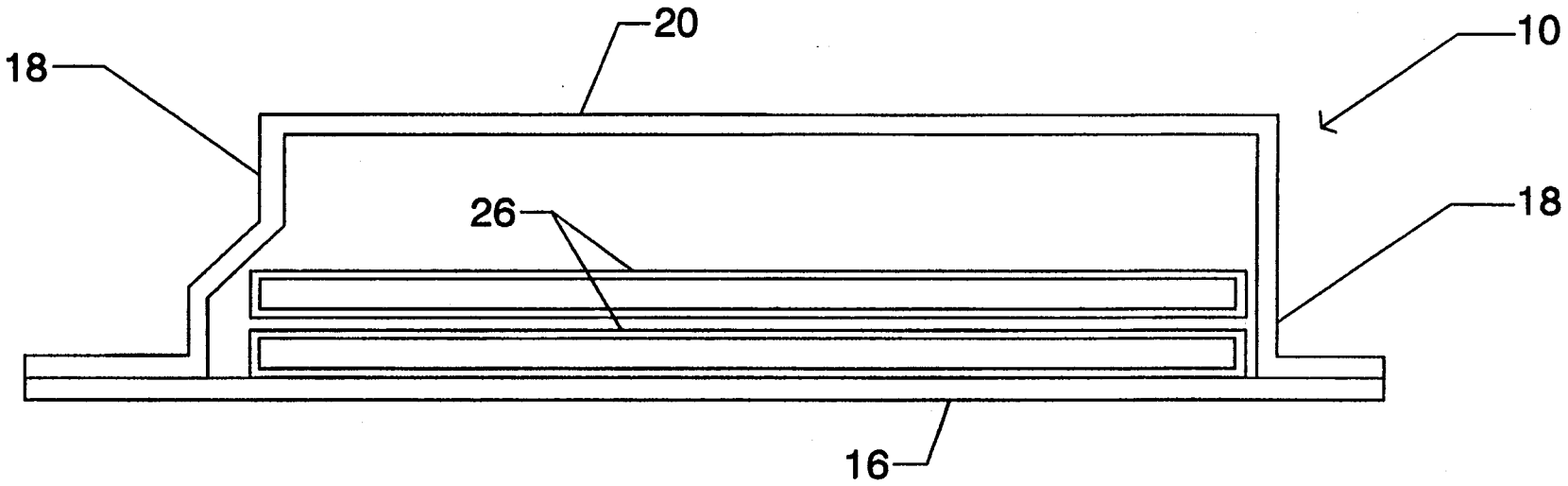
FIG. 4A, 4B, and 4C are views similar to FIGS. 2 and 3, showing various arrangements of the explosive cassettes of the invention.
Figure 4:
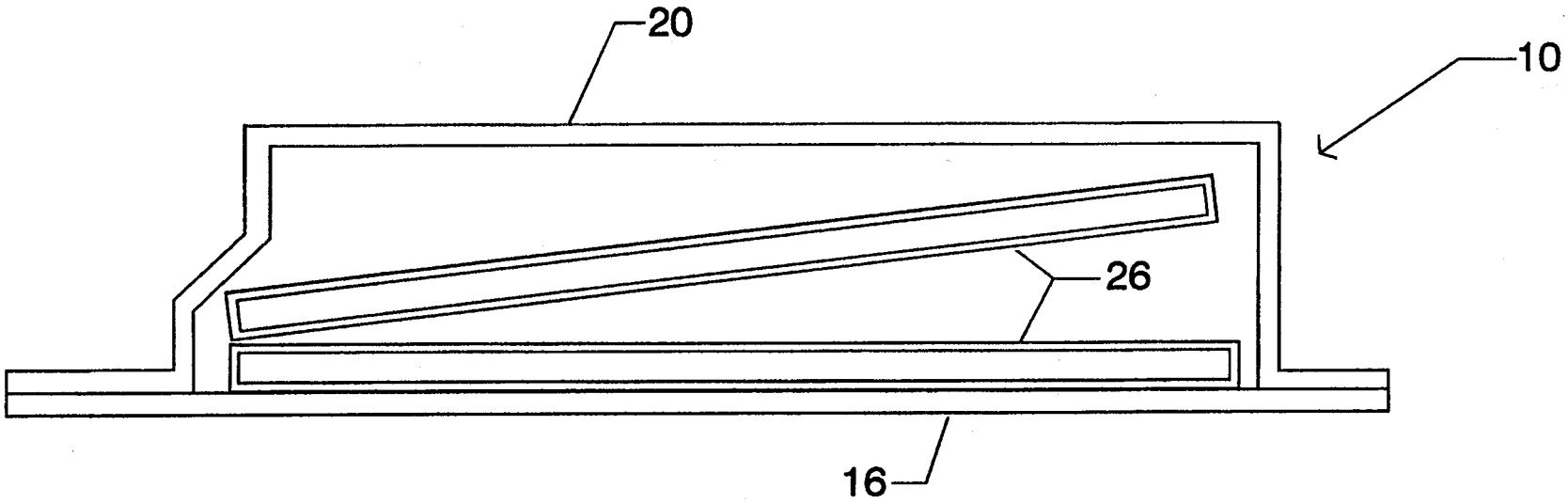
Figure 4:
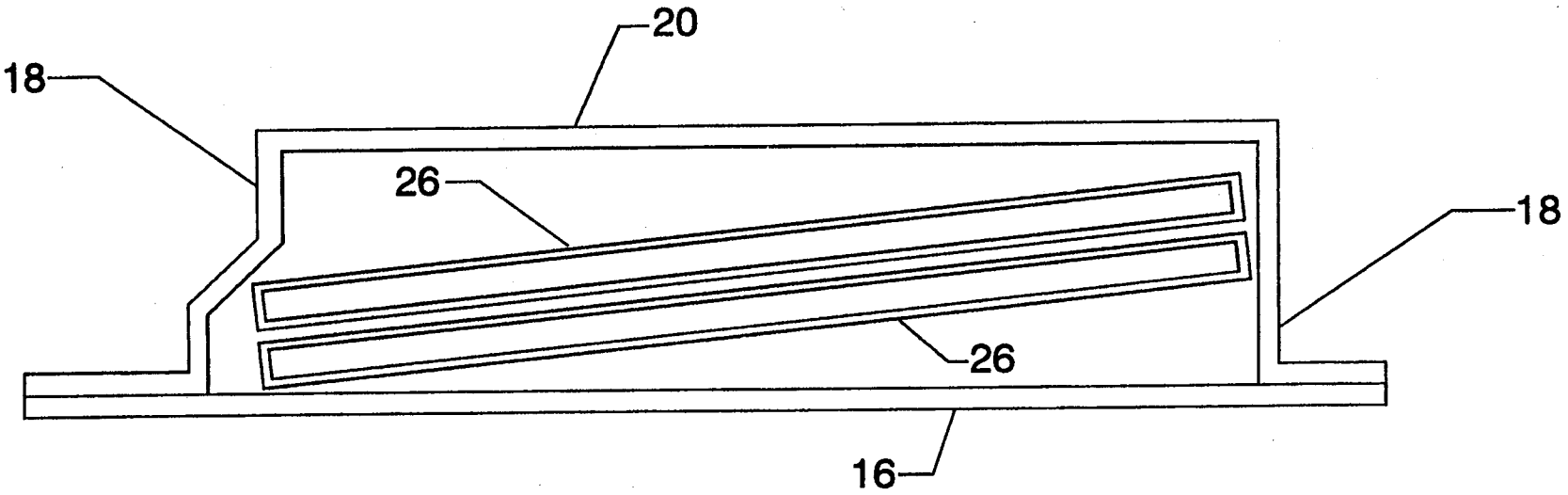

FIGS. 4A, 4B, and 4C illustrate examples of how cassettes 26 may be arranged in the armor boxes of the invention. The number of and the placement of the cassettes may be varied, depending on the nature of the threat of the protected surface.

While two particular embodiments of invention have been described in detail, it will be readily understood by those skilled in the art that a variety of configurations can be used which will utilize the principles of the invention as set forth without departing from the structure recited in the appended claims.

I claim:

1. A reactive armor box for use in protecting armor surfaces from projectiles, comprising:

a) a base for attachment to the armor surface to be protected;

b) a plurality of walls extending from said base at an angle to said base to provide an enclosed space;

c) a plurality of explosive cassettes disposed within said enclosed space and supported and contained within said walls; and d) a top attached to said walls to contain said cassettes in said enclosed space, composed of a composite material having radar absorbing characteristics for absorbing radio waves of said radar to avoid detection of said protected armor surface and to protect said armor surface from projectiles utilizing radio frequency guidance seekers.

2. A reactive armor box as set forth in claim 1, wherein said top is removably secured to said walls by releasable attaching means.

3. A reactive armor box as set forth in claim 2, wherein said top is secured by mechanical means.

4. A reactive armor box as set forth in claim 1, wherein said base has means on its outer surface for releaseably attaching said box to said armor surfaces.

5. A reactive armor box as set forth in claim 4, wherein said means for attaching said box to said armor surface comprises a releasable fastener.

6. A reactive armor box as set forth in claim 1, wherein said top is integral with at least some of said walls and said base.

7. A reactive armor box as set forth in claim 1, wherein said top is bonded to said wells and base by an adhesive.

8. A reactive armor box as set forth in claim 1, wherein said composite material comprises a S-2 glass-/epoxy composite having an average density of 2.20 g/cc and an average elasticity modulus of $0.317\times10^6$ $Kg/c^2$.

9. A reactive armor box as set forth in claim 1, wherein said box is composed of a composite material which is radar absorbent.

10. A reactive armor box as set forth in claims 9, wherein said composite material comprises a S-2 glass-/epoxy composite having an average density 2.20 g/cc and an average elasticity modulus of $0.317\times10^6$ Kg/c$^2$.

11. A reactive armor box for use in protecting armor surfaces from projectiles, comprising:

a) a rigid base having means on one of its sides for attachment to said armor surface to be protected;

b) a plurality of walls, at least some of which extend from said base at a right angle to said base to provide an enclosed space;

c) a plurality of explosive cassettes disposed within said enclosed space and supported and contained within said walls; and d) a top attached to said walls to contain said cassettes in said enclosed space, composed of a composite material having radar absorbing characteristics for absorbing radio waves of radar to avoid detection of said armor surface and to protect said armor surface form projectiles utilizing radio frequency guidance seekers.

12. A reactive armor box as set forth in claim 11, wherein said top is removably secured to said walls by releasable attaching means.

13. A reactive armor box as set forth in claim 11, wherein said top is attached by mechanical means.

14. A reactive armor box as set forth in claim 11, wherein said base has means on its outer surface for releaseably attaching said box to said armor surface.

15. A reactive armor box as set forth in claim 14, wherein said means for attaching said box to said armor surface comprises a releasable fastener.

16. A reactive armor box as set forth in claim 11, wherein said top is integral with said walls and said base.

17. A reactive armor box as set forth in claim 12, wherein said top is bonded to said walls and base by an adhesive.

18. A reactive armor box as set forth in claim 12, wherein said composite material comprises a S-2 glass-/epoxy composite having an average density of 2.20 g/cc and an average elasticity modulus of $0.317\times10^6$ Kg/c$^2$.

19. A reactive armor box as set forth in claim 11, wherein said box is composed of a composite material which is radar absorbent.

20. A reactive armor box as set forth in claim 19, wherein said composite material comprises S-2 glass-/epoxy composite having and average density of 2.20 g/cc and an average elasticity modulus of $0.317\times10^6$ Kg/c$^2$.

* * * * *